United States Patent [19]

Gostling

[11] 3,968,616

[45] July 13, 1976

[54] DECKING BEAM ASSEMBLY

[75] Inventor: Peter Eric Gostling, Sutton Coldfield, England

[73] Assignee: C. Evans & Sons Limited, Illford, United Kingdom

[22] Filed: Oct. 4, 1974

[21] Appl. No.: 511,950

[30] Foreign Application Priority Data

Oct. 12, 1973 United Kingdom ..... 47798/73

[52] U.S. Cl. ..... 52/645; 52/692; 52/694

[51] Int. Cl.[2] ..... E04C 3/02

[58] Field of Search ..... 52/694, 692, 637, 638, 52/645, 335, 487, 263, 262, 460, 461, 464, 468, 643, 693, 648

[56] References Cited

UNITED STATES PATENTS

| | | | |
|---|---|---|---|
| 2,904,851 | 9/1959 | Griffin et al. | 52/461 X |
| 3,062,340 | 11/1962 | Hunnebeck | 52/643 X |
| 3,362,121 | 1/1968 | Weber | 52/694 X |

*Primary Examiner*—Ernest R. Purser
*Assistant Examiner*—Carl D. Friedman
*Attorney, Agent, or Firm*—Melville, Strasser, Foster & Hoffman

[57] ABSTRACT

A decking beam assembly for use with builders scaffolding which is arranged and constructed to enable different shapes and sizes of filler element to be fixed thereto in order to permit the use of different standard types of decking panels in constructing shuttering for concrete floors.

6 Claims, 10 Drawing Figures

DECKING BEAM ASSEMBLY

This invention relates to a decking beam assembly for use in the construction of roofs, ceilings, floors and the like.

Decking beams are used in combination with builders scaffolding to provide a support structure for shuttering in the form of decking panels or the like and it is well known that different scaffolding systems vary slightly as to the spacing of the props or uprights by which the decking beams are supported. Because of this, the sizing of the decking panels also varies with the result that these panels are only usuable with the particular scaffolding system for which they are made.

It is among the objects of the present invention to provide a decking beam assembly which is adaptable for use with a plurality of different sizes of decking panels.

According to the present invention, there is provided a decking beam assembly, which comprises a lower stringer member, a pair of spaced panel supporting upper members, connecting means extending between the lower stringer member and the respective panel supporting members, a plurality of spaced tie members extending between the two panel supporting members, a replaceable filler element supported by the panel supporting members, and means for retaining the filler element in position relative to the supporting members.

The tie members may be in the form of non-adjustable tie plates or the like, or in the form of a nut and bolt. Preferably also the panel supporting members are angle irons and the connecting means are in the form of zig-zag bars which are welded to the stringer member and to the panel supporting members.

Figure 2:
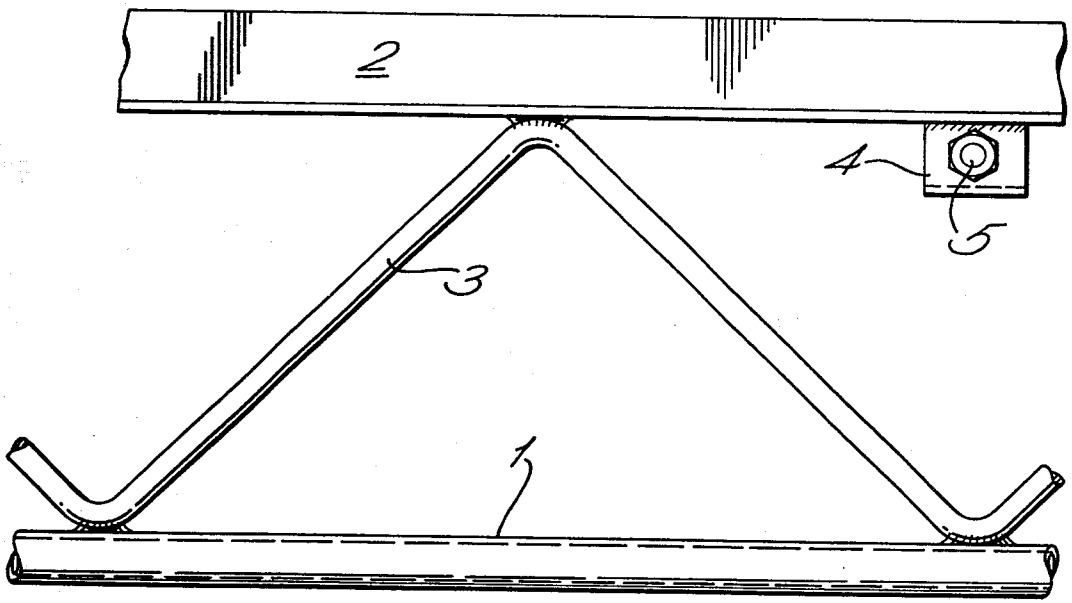
Figure 1:
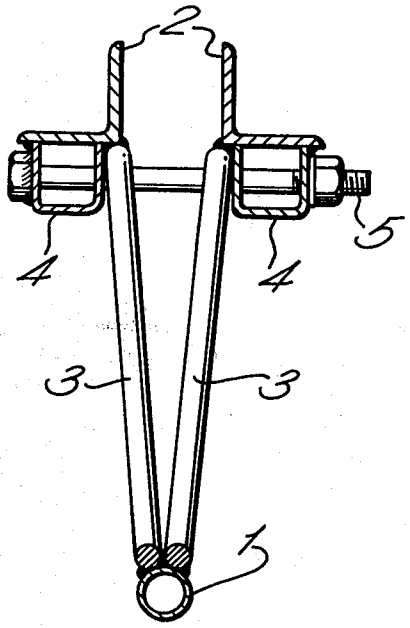
Figure 5:
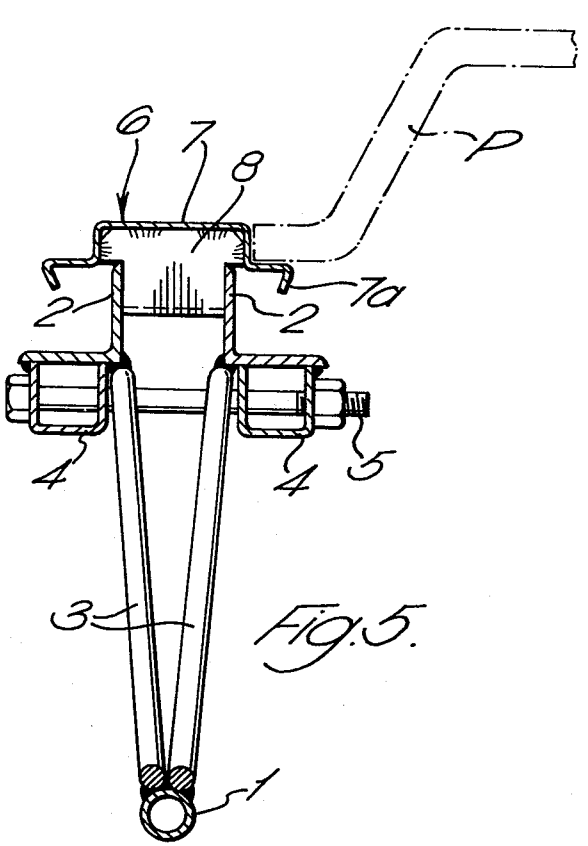
Figure 6:
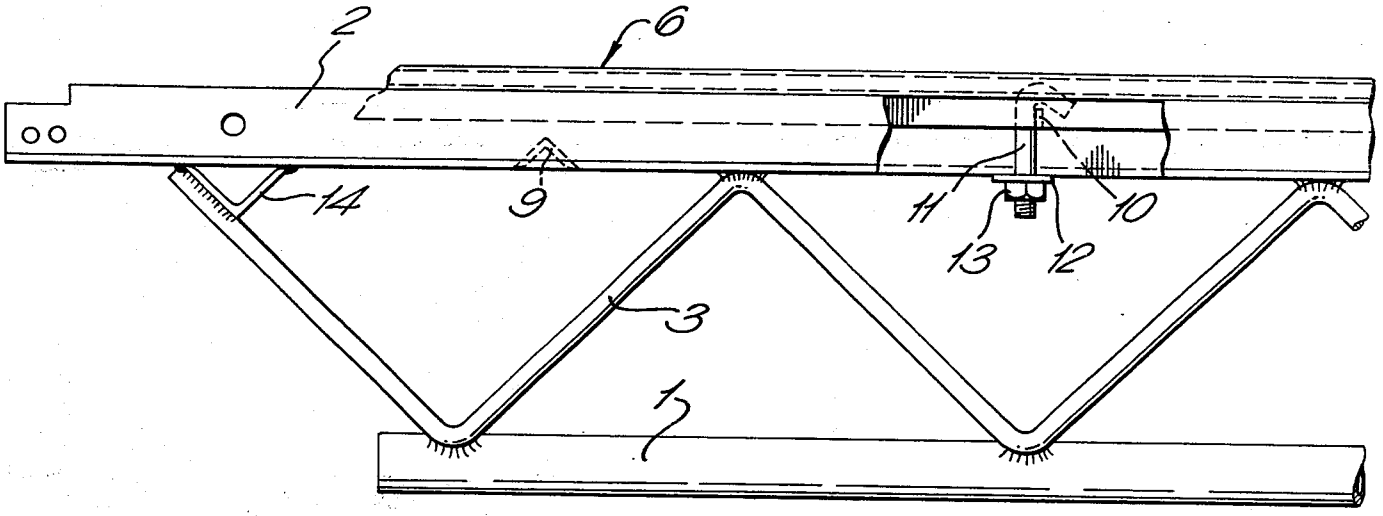
Figure 7:
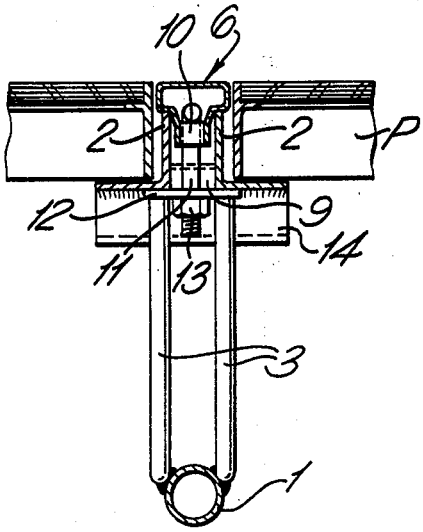
Figure 8:
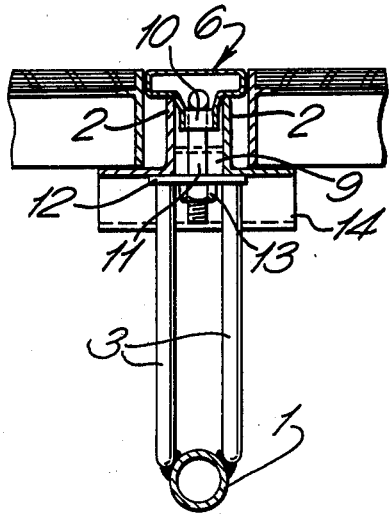
Figure 9:
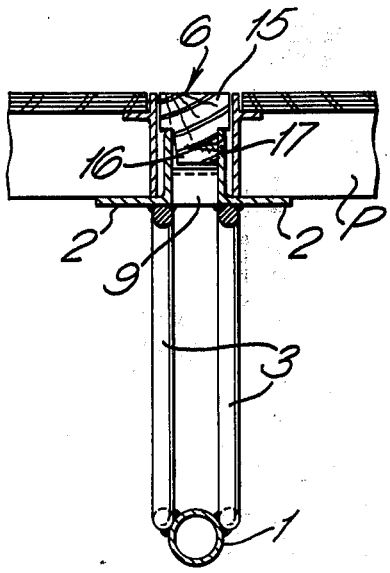
Figure 10:
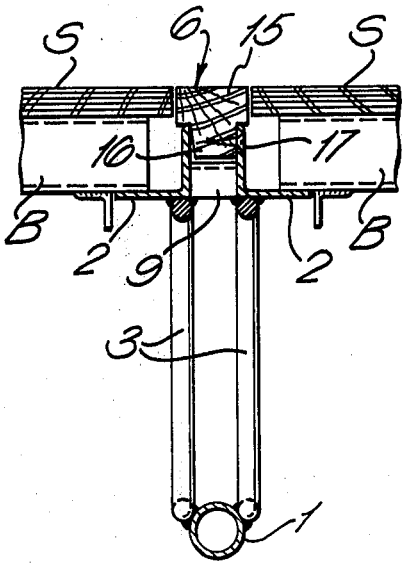

The invention is illustrated by way of example in the accompanying drawings in which, FIG. 1 is a cross-section through a decking beam according to the invention, FIG. 2 is a part elevation corresponding to FIG. 1, FIGS. 3, 4 and 5 are sections corresponding to FIG. 1 showing the adaption of the beam to different sizes of decking panel, FIG. 6 is a part elevation of a modification, FIGS. 7 and 8 are cross-sections on FIG. 6 showing a beam for use with two different sizes of decking panel, and FIGS. 9 and 10 are cross-sections through a beam showing further alternative arrangements.

Referring to FIGS. 1 and 2 of the drawings, a decking beam comprises a lower stringer member 1, which may be tubular, and a pair of spaced panel supporting upper members 2 in the form of angle irons, the stringer member 1 and the respective panel supporting members 2 being interconnected by zig-zag bars 3 which are welded in position so as to present a V-shaped formation in cross-section.

At spaced positions along the length of the panel supporting members 2 are U-shaped brackets 4 which are welded to corresponding flanges of the members 2, the brackets having correspondingly positioned apertures to receive a nut and bolt 5 which interconnects the two brackets, the head of the bolt being welded to its co-acting bracket 4.

It will be appreciated that the arrangement of the bars 3 is such that the panel supporting members 2 are held apart by the resilience in the bars and the actual spacing between the members 2 is controlled by the nut and bolt arrangement 5.

Figure 3:
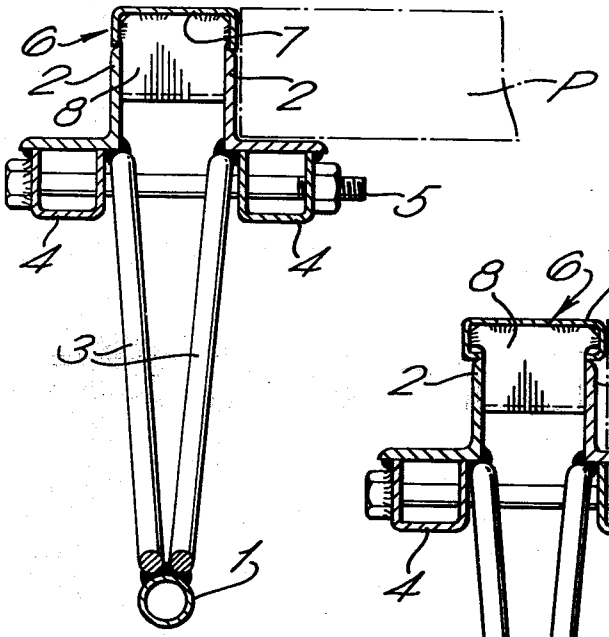

In practice, as shown in FIG. 3, decking panels P of one size are supported on the members 2 and fit exactly into the angles thereof. The space between the members 2 is determined, and covered in order to provide a continuous surface with the panels P, by a spacer or filler element 6. The element 6 consists of an inverted channel-shaped member 7 having spaced transverse webs 8 which extend into the space between the members 2, and are gripped by the members 2 on tightening of the nut and bolt arrangement 5.

Figure 4:
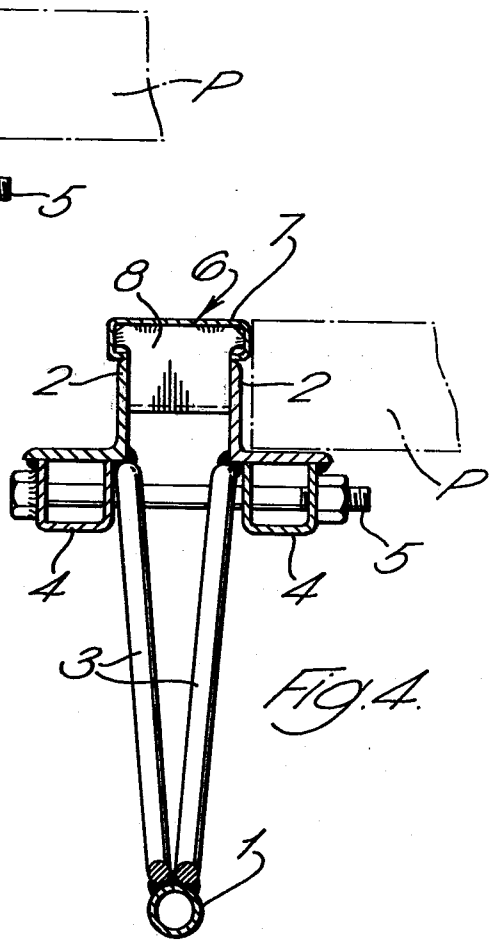

In the arrangement of FIG. 4, the panels P are smaller and the channel-shaped member 7 of the filler element 6 is provided to overhang the members 2 so that, although the panels P are supported by the horizontal flanges of the members 2, the edges of the panels abut its overhanging member 7 and not the upright flanges as in the previous embodiment.

FIG. 5 shows the beam adapted for use with castellated panels P. In this case, the member 7 of the filler element 6 in addition to overhanging the members 2, is extended to present secondary flanges 7*a* to receive the edges of the panels P. Thus, in this arrangement, the panels P are indirectly supported by the panel supporting members 2, the width of the member 7 being varied to suit the size of the panel P.

In the aforementioned arrangements it will be seen that the nut and bolt 5 provides the means for retaining the filler element 6 in position between the supporting members 2.

Referring to FIGS. 6, 7 and 8 of the drawings, there are shown alternative embodiments of decking beam assembly which comprise, as in the previous embodiments, a lower stringer member 1, a pair of spaced panel supporting members 2 and zig-zag bars 3 interconnecting the lower stringer member 1 and the respective supporting members 2. In this arrangement, the space between the support members 2 is of a fixed size which is determined by non-adjustable tie plates 9 in the form of inverted V-shaped members arranged at spaced intervals along the length of the beam and welded at their ends to the members 2.

In this arrangement also the filler element 6 comprises a metal section of hollow T-shaped cross-section having, at spaced intervals along the length thereof, transverse tie plates 10 extending between, and welded to, the spaced tail portions of the T.

The means for retaining the filler element 6 in position relative to the supporting member 2 comprise hook bolts 11. Thus, in practice, the filler element 6 is positioned so that the crossbar of the T engages the uppermost edges of the members 2 with the tail of the T disposed between the members 2. The hook of the bolt 11 is engaged over the tie plate 10 and the other end thereof extends through a bearing plate 12 extending between the members 2, a nut 13 being provided to bear against the bearing plate and to pull the filler element 6 into tight engagement with the members 2.

In use, decking panels P are supported on the support members 2 on opposite sides of the filler element 6 the width, i.e. the length of the crossbar of the T, of which is varied according to the size of the panels P being used as can be seen by comparing FIGS. 7 and 8.

As can be seen in FIG. 6, the beam hereinbefore described is formed at its ends to be attached to suitable support scaffolding, and the ends of the zig-zag bars 3 are fixed to the undersides of the members 2 via V-shaped plates 14.

In a modification of the embodiments shown in FIGS. 6, 7 and 8, as is shown in FIGS. 9 and 10, the non-adjustable tie plates 9 are in the form of angle irons which are welded to the members 2, and the filler element 6, instead of being a metal section, is timber. In this case, the element 6 is also of generally T-shaped cross-section with the length of the crossbar 15 thereof being varied according to the size of the decking panels P.

To facilitate insertion of the element 6 between the members 2, the tail portion 16 of the T is tapered with one face thereof lying parallel to one of the members 2 and the other face thereof lying at a slight angle to the other of the members 2. The means for retaining the filler element 6 in position comprise screws 17 which pass through spaced holes in one of the support members 2.

In practice, as is shown in FIG. 9, the beam is used to support proprietary panels P in the manner hereinbefore described. Alternatively, as shown in FIG. 10, the beam is used to support infill beams B which, in turn, support timber or other sheets S which serve the same purpose as the panels P.

From the above, it will be seen that a shuttering support structure can be provided using any known standard size of decking panel whilst retaining the same center-to-center spacing of the decking beams, and thus also of the scaffolding supporting the decking beams.

I claim:

1. A decking beam assembly for use in combination with support panels to provide shuttering for concrete structures, said beam assembly being adaptable for use with standard support panels of different sizes and comprising a lower stringer member, a pair of spaced-apart panel supporting upper members in the form of angle irons, connecting means in the form of zig-zag bars extending between, and fixedly secured to, said lower stringer member and respective ones of said panel supporting members, a plurality of spaced adjustable tie members extending between and connected to said two panel supporting members, a replaceable spacer element of generally T-shaped cross-section supported by said panel supporting members, said spacer element having a crossbar portion opposite ends of which are engaged by one edge of each of two adjacent ones of said support panels and a tail portion which is received between said two panel supporting members, and means for retaining said tail portion of said spacer element in position relative to said panel supporting members, the arrangement being such that said adjustable tie members permit a selected one of said replaceable spacer elements to be used depending on the size of said support panels.

2. An assembly as claimed in claim 1, in which said tie members each comprise a nut and bolt arrangement which extends through brackets secured to said panel supporting members.

3. An assembly as claimed in claim 2, in which said spacer element comprises an inverted channel-shaped metal section providing said crossbar portion and spaced transverse webs providing said tail portion which webs are positioned between said panel supporting members and secured therein by means of said nut and bolt arrangement.

4. An assembly as claimed in claim 3, in which said channel-shaped metal section forming said spacer element is provided with secondary flanges to receive support panels whereby said support panels are supported indirectly by said panel supporting members.

5. A decking beam assembly for use in combination with support panels to provide shuttering for concrete structures, said beam assembly being adaptable for use with standard support panels of different sizes and comprising a lower stringer member, a pair of spaced-apart panel supporting upper members in the form of angle irons, connecting means in the form of zig-zag bars extending between, and fixedly secured to, said lower stringer member and respective ones of said panel supporting members, a plurality of spaced tie members extending between and connected to said two panel supporting members, a replaceable spacer element of generally T-shaped cross-section ion supported by said panel supporting members, said spacer element comprising a timber member having a cross bar portion opposite ends of which are engaged by one edge of each of two adjacent ones of said support panels and a tail portion which is received between said two panel supporting members, said tail portion being tapered and having one face parallel to the co-acting face of one of said supporting members and the other face inclined relative to the co-acting face of the other of said supporting members, and means for retaining said tail portion of said spacer element in position relative to said panel supporting members, wherein said tie members comprise tie plates positioned at spaced intervals between said supporting members and fixed thereto to provide an unadjustable space between said supporting members, the arrangement being such that a selected one of said replaceable spacer elements may be received and retained between said panel supporting members depending on the size of said support panels.

6. An assembly as claimed in claim 5, in which said means for retaining said spacer element in position comprise screws which are passed through one of said panel supporting members.

* * * * *